US006659407B2

(12) United States Patent
Asaro

(10) Patent No.: US 6,659,407 B2
(45) Date of Patent: Dec. 9, 2003

(54) COLLAPSIBLE TRASH BAG STAND WITH PUNCH TAB BAG RETAINERS

(76) Inventor: Vito Frank Asaro, 12551 Carmel Canyon Rd., San Diego, CA (US) 92130

( * ) Notice: Subject to any disclaimer, the term of this patent is extended or adjusted under 35 U.S.C. 154(b) by 0 days.

(21) Appl. No.: 10/095,826

(22) Filed: Mar. 12, 2002

(65) Prior Publication Data

US 2002/0130224 A1 Sep. 19, 2002

Related U.S. Application Data

(60) Provisional application No. 60/275,019, filed on Mar. 13, 2001, and provisional application No. 60/305,357, filed on Jul. 16, 2001.

(51) Int. Cl.[7] ..... A63B 55/04

(52) U.S. Cl. ..... 248/97; 220/495.11; 248/95; 383/33

(58) Field of Search ..... 248/97, 95, 99, 248/100, 101; 383/33; 220/495.11

(56) References Cited

U.S. PATENT DOCUMENTS 4,957,252 A * 9/1990 Watkins ..... 248/100
4,974,746 A * 12/1990 Dickinson ..... 209/702
5,028,022 A * 7/1991 Metcalf ..... 220/495.11
5,054,724 A * 10/1991 Hutcheson ..... 220/495.11
5,129,609 A * 7/1992 Tobin ..... 141/316
5,271,589 A * 12/1993 Belous ..... 248/97
5,419,452 A * 5/1995 Mueller et al. ..... 220/495.08
5,868,294 A 2/1999 Webster
5,897,084 A 4/1999 Judge
5,924,657 A 7/1999 Bach
5,997,178 A 12/1999 Nye et al.
6,003,820 A 12/1999 Baldonado et al.
6,007,030 A 12/1999 Judge
D418,653 S 1/2000 Kent, Jr.
6,068,221 A 5/2000 Rosen
D426,364 S 6/2000 King
6,086,022 A 7/2000 Dalton
6,367,747 B1 * 4/2002 Mulle ..... 248/97

* cited by examiner

*Primary Examiner*—Anita King
*Assistant Examiner*—Tan Le
(74) *Attorney, Agent, or Firm*—Henri J. A. Charmasson; John D. Buchaca

(57) ABSTRACT

A collapsible trash bag stand having a sleeve-shaped body made from durable semi-rigid sheet material and having a plurality of punch-out, retainer tabs that snap into position to prevent the bag from slipping into the stand and to accommodate loading of multiple layers of trash bags at one time.

9 Claims, 3 Drawing Sheets

COLLAPSIBLE TRASH BAG STAND WITH PUNCH TAB BAG RETAINERS

PRIOR APPLICATION

This Application claims the benefit of U.S. Provisional Patent Application Serial No. 60/275,019 filed Mar. 13, 2001, and U.S. Provisional Patent Application Serial No. 60/305,357 filed Jul. 16, 2001.

FIELD OF THE INVENTION

This invention relates to collapsible supports for flexible bags and more particularly to such supports for disposable plastic refuse bags.

BACKGROUND OF THE INVENTION

The ordinary plastic or vinyl trash bag is commonly used as a liner in conjunction with trashcans. The trashcan also serves as a stand to hold the trash bag open. On the other hand, the bag may be separately used to hold waste without a trashcan. When the bag is used as a resceptical for waste without a trashcan, the user has difficulty keeping the bag open with one hand while attempting to insert waste into the bag with the other hand.

A different problem occurs, on the other hand, when using the bag in conjunction with a trashcan. The top of the bag often slips into the trashcan while it is being filled. If that happens, later there is difficulty extracting the filled trash bag from the can without spilling trash.

The standard rigid trashcan takes up storage space and is generally heavier when filled, and more awkward to move around, than separate, filled trash bags. For these reasons users try to avoid keeping extra trashcans on hand. But then, when the need arises and no extra trashcans are on hand, the user is often relegated to using separate trash bags with no stand for holding them open. An instant, collapsible trash container would be useful for yard clean up, bagging trash piles, work shop clean up, separating recyclables, house parties, beach parties and cookouts, kitchens, moving and storage, in campers, motor homes, and utility vehicles, among many other uses.

Instant, collapsible stands, equipped with retainers to keep the bags in place and to allow loading of multiple layers of bags, would be the answer, but the extra cost of adding retainers to trashcans or trash bag stands, is a problem.

Therefore, there is a need for a support which addresses the problems identified above.

SUMMARY OF THE INVENTION

The principal and secondary objects of the invention are to provide an instant, storable, portable, reusable, collapsible, and optionally disposable light-weight trash bag stand that can be stored flat but may be opened to receive a trash bag, is malleable to different shapes, and is equipped to releasably carry a plurality of bags.

These and other objects are achieved by a sleeve-shaped body made from durable semi-rigid sheet material having a plurality of punch-out, retainer tabs that snap into position to prevent the bag from slipping into the stand and to accommodate loading of multiple layers of trash bags at one time.

DESCRIPTION OF THE PREFERRED EMBODIMENT OF THE INVENTION

Figure 1:
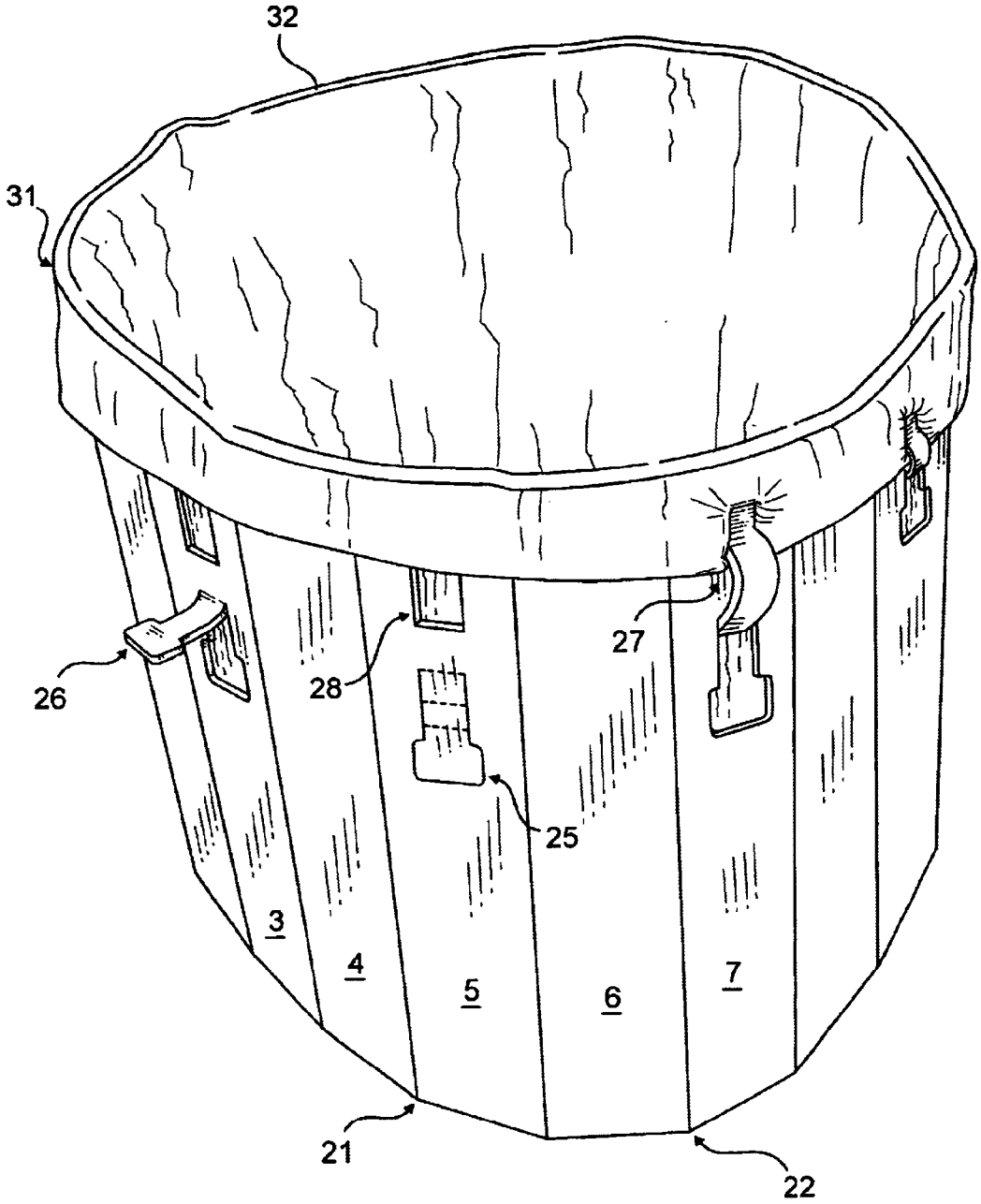
FIG. 1 is a diagrammatic perspective view of the trash bag stand according to the invention, open, with trash bag inserted, with most retainers snapped into place, trapping the upper edge of the bag. It shows the vertical panels 3–7, the outside view of the vertical scoring lines 21, 22, and an unbroken-out tab 25 and a broken-out tab 26.
Figure 2:
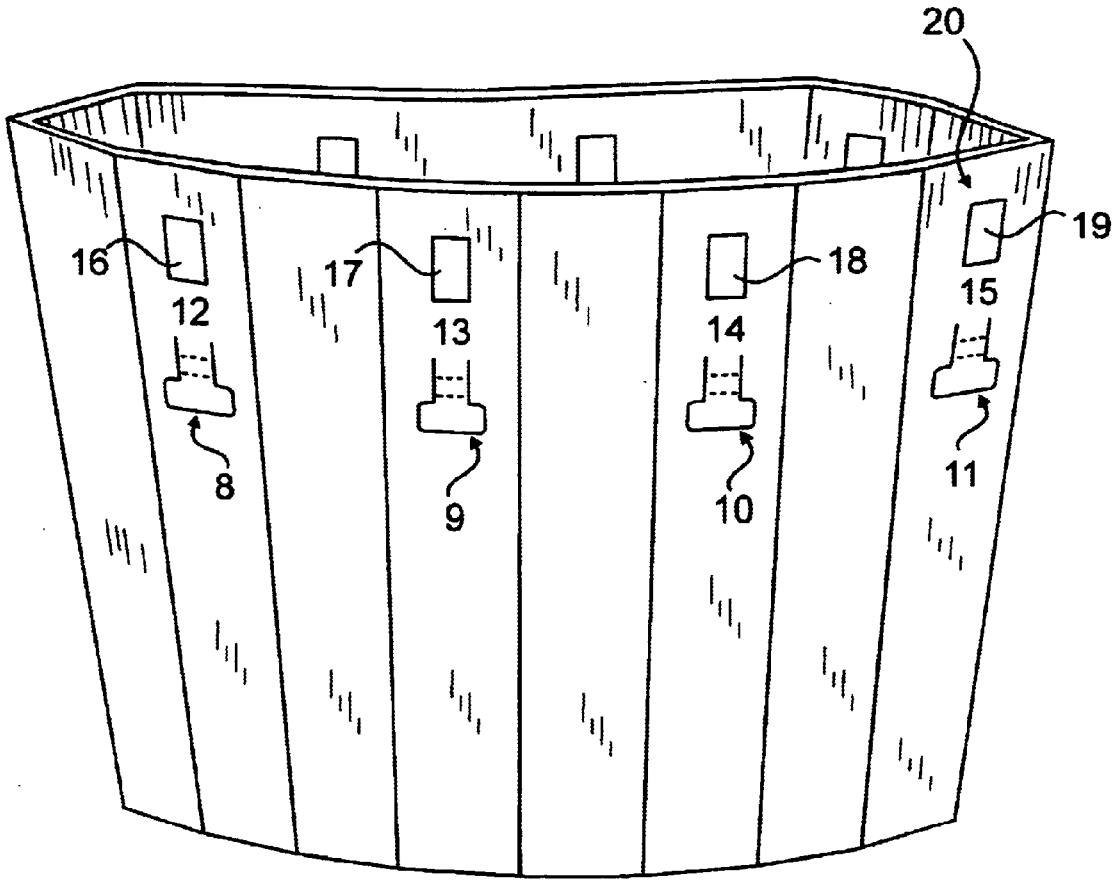
FIG. 2 is a diagrammatic perspective view of the trash bag stand, collapsed, lying flat but slightly open, showing primarily a one-side view of dye-cut retainers 8–11 before they are broken out, attached to a bands 12–15 just below cut-out slots 16–19. The cut-out slots are situated within an inch of the top rim 20 of the stand.

Referring now to the drawing, this invention comprises: a light-weight, pop-open, instant, collapsible, flat-pack-storable, portable, reusable, and optionally disposable 26, and snaps into position FIG. 1, 27 trapping the top fringe of the liner-trash bag in the slot FIG. 2, 16–19; FIG. 1, 28, preventing the bag from slipping into the stand. The walls of the stand open into a multi, equal sided, paneled, sleeve FIG. 1, 3,4,5,6,7, that may be collapsed flat or folded flat for storage FIG. 2 when not in use. By alternating retainer tabs FIG. 2, 8.10 and 9, 11, multiple layers of trash bag liners may be loaded, and then extracted successively as each bag is filled.

Figure 3:
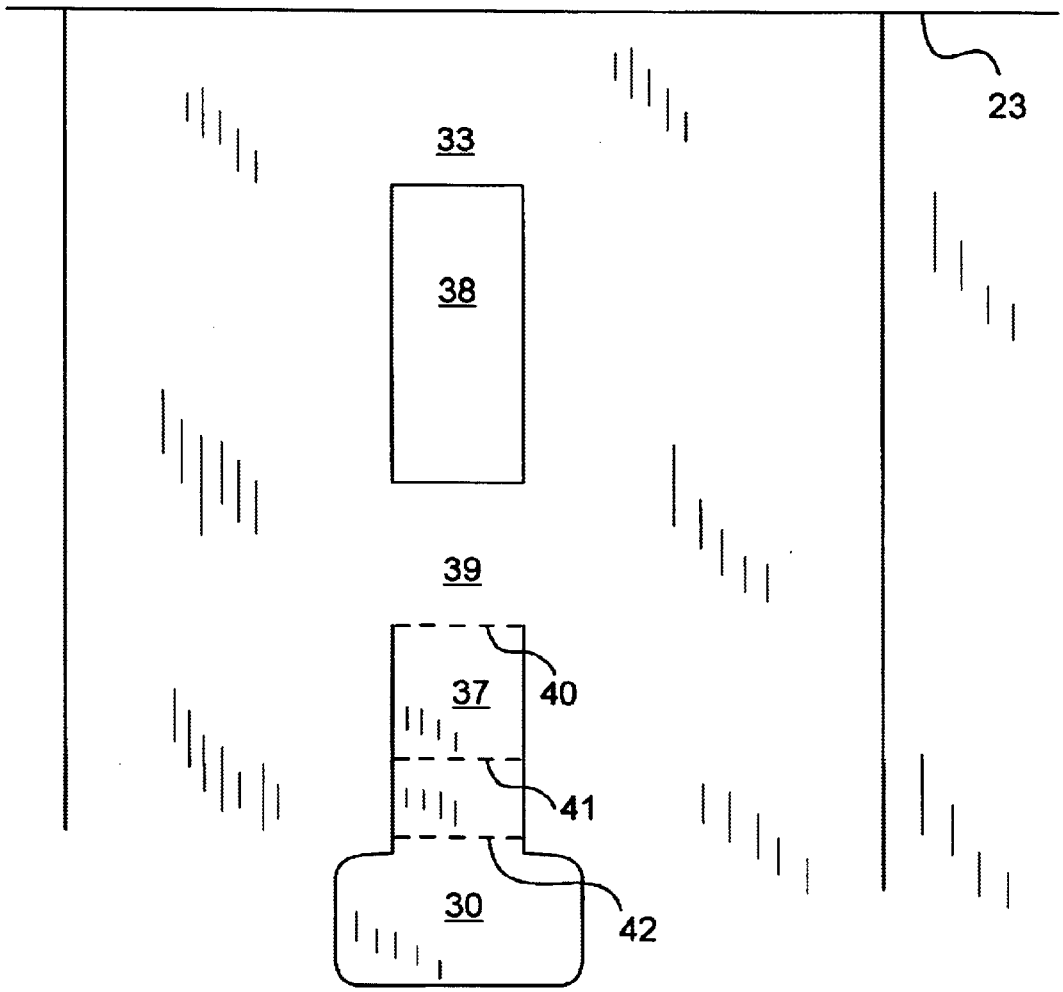
FIG. 3 is a diagrammatic side view showing the dye-cut lines of the retainer-punch-out tabs, together with the scoring lines, which set the folds of the retainer tabs.

The cost of manufacture of the stand with retainers is kept to a minimum by utilizing one rectangular sheet of stiff or rigid plastic, corrugated plastic, cardboard, or other similar material. The sheet is then scored on vertical folds at such equal intervals FIG. 1, 21, 22, so that upon joining together each horizontal end of the scored sheet the multi-sided sleeve will lie flat FIG. 2 when collapsed. Before the sheet is joined into a sleeve in the manufacturing process, however, retainer tabs FIG. 2, 8–11 and open slots above them FIG. 2, 16–19 are stamp-cut at equal intervals along the upper edge FIG. 3, 23, which becomes the band FIG. 2, 20 at the upper rim of the sheet or stand. The tabs, acting as fingers dropping down from below the slots at the rim, widen at the their tips or heads FIG. 3, 30. After the stand is set up by the user/consumer, the bag is inserted and opened, with the open top of the bag FIG. 1, 32 stretched over the rim or lip FIG. 1, 31 of the stand. The tabs are then punched out by the user from the inside of the bag and stand, FIG. 1, 26, where the tabs had been cut by the manufacturer (likely by dye-cut) below the slots FIG. 3, 38; FIG. 1, 28. The tabs are then folded out by the user and up toward the rim FIG. 1, 26. Then the heads of the tabs FIG. 3, 30 are snapped by the user into the narrower open slots FIG. 1, 27. Each retainer tab, as it is snapped into place, thus traps the bag liner top into each open slot.

The shape of the stand, from an overhead view FIG. 1 with or without bag inserted, is malleable by the user to most shapes desired, including round, elliptical, half-moon, boomerang, rectangle, square-ish, and so forth. The tabs FIG. 3, 37, which extend down from bands FIG. 3, 39 below the slots FIG. 3, 38 at the the top rim of the stand FIG. 3, 23 or can, are cut far enough below the rim and slots so they may be attached to sturdy section FIG. 3, 39. Such are wide enough to be sturdy at the section at the bottom of the slots, yet the tabs are high enough so that they retain the upper edge of bag outside the rim of the stand, and as close to the top of the stand or can as possible. The band at the rim, FIG. 3, 33 between the slots and the rim, above the slots shone here is generally 13/16ths of an inch from rim to slot. The tabs are generally ¾" wide 37, widening generally to 1¼ inch at their tip or head 30. The open slots 38 are ¾ths inch wide and 1⅝ths" long, more or less, from top to bottom thereof. At the bottom of the 13/16ths inch section below the slots, where the tab joins it 40, there is a horizontal scoring on the surface of the tab 40 enabling it to break out, folding to the outside of the stand. There is a second horizontal scoring on the surface of the tab 41, accommodating a second horizontal fold where the head of the tab is brought up to the middle of the open slot at the top of the stand, generally 13/16ths inch from the first scoring, There is a third horizontal scoring on the surface of the tab 42 parallel to the second scoring at a distance of approximately ⅜ths inch from the second scoring. This allows the tab to fold up and bend into the slot. The up-side-down head or tip of the tab 30 is wider than the finger portion 37 and the slot 38, so that it will be punched from the inside of the stand, through the slot 38 and be trapped on the inside of the stand FIG. 1, 27.

The third horizontal scoring 42 approximately 1/16th" up from the widened tip, causes the tab to fold, allowing the tip to anchor or lock flat against the inside of the slot, trapping the upper fringe of the bag upon being fastened.

While the preferred embodiments of the invention have been described, modifications can be made and other embodiments may be devised without departing from the spirit of the invention and the scope of the appended claims.

What is claimed is:

1. A collapsible stand for holding a flexible bag comprises:

a sleeve-shaped body having a sidewall terminating at a top rim bordering a top opening;

a first slot being formed into said sidewall and located proximate to said rim;

and having a first dimension;

and a first tab being formed into said having a first connected end and a second free end having a widened end portion having a second dimension greater than said first dimension; and wherein said free end is further formed to have a pair of resilient side ears which, when folded, allow said free end to penetrate through said slot, and when released spring open thereby restricting retraction of said free end from said slot.

2. The stand of claim 1, wherein said top rim circumscribes said top opening.

3. The stand of claim 1, wherein said tab is generally T-shaped and said widened portion forms the top of the T.

4. The stand of claim 1, wherein said tab is formed by a cut section of said sidewall.

5. The stand of claim 1, wherein said first connected end is located a first distance from said slot.

6. The stand of claims 5, wherein said second free end is located a second distance from said slot, and wherein said second distance is greater than said first distance.

7. The stand of claim 1, which further comprises a plurality of additional slots and tabs formed similarly to said sidewall and spaced apart along a band adjacent to said rim.

8. A retainer for securing a flexible sheet to a semirigid sheet body, said retainer comprises:

a semirigid sheet body having a front surface, a back surface, a first slot being formed into extending through said surfaces;

a first tab being formed into said body and having a first connected end and a second free end;

wherein said second free end terminates in an engagement for engaging said slot;

wherein said engagement comprises:

a pair of resilient side ears which, when folded, allow said second free end to penetrate through said slot, and when released spring open thereby restricting retraction of said free end from said slot.

9. A process for forming a collapsible stand for holding a flexible bag comprises:

selecting a piece of semirigid, resilient sheet material;

cutting a slot into said piece; and cutting a tab structure into said piece proximate to said slot;

wherein said tab structure comprises a first connected end and a second free end terminating in a pair of resilient side ears which, when folded, allow said free end to penetrate thorugh said slot, and when released spring open thereby restricting retraction of said free end from said slot.

* * * * *